US005192226A

United States Patent [19]

Wang

[11] Patent Number: 5,192,226

[45] Date of Patent: Mar. 9, 1993

[54] DOUBLE-OUTPUT PORT CABLE ASSEMBLY FOR NOTEBOOK COMPUTERS

[76] Inventor: Tsan-Chi Wang, 1 F., No. 13, Lane 312, Chung Chen Rd., Hsin Tien City, Taipei Hsien, Taiwan

[21] Appl. No.: 878,971

[22] Filed: May 6, 1992

[51] Int. Cl.[5] ..... H01R 11/00

[52] U.S. Cl. ..... 439/502; 439/578; 439/639; 439/640; 439/650

[58] Field of Search ..... 439/502, 505, 578, 581, 439/609, 610, 624, 638-640, 650-653

[56] References Cited

U.S. PATENT DOCUMENTS 4,236,779 12/1980 Tang ..... 439/638
4,579,407 4/1986 Shimada ..... 439/502
4,830,629 5/1989 Yoshimura ..... 439/610
4,941,845 7/1990 Eppley et al. ..... 439/502
5,119,020 6/1992 Massey et al. ..... 439/502

FOREIGN PATENT DOCUMENTS 0288176 11/1990 Japan ..... 439/502

*Primary Examiner*—Paula A. Bradley
*Attorney, Agent, or Firm*—Varndell Legal Group

[57] ABSTRACT

A cable assembly comprised of a connector assembly having a male D-miniature connector, an output adapter having two female D-miniature connectors, and a coaxial cable connected between said connector assembly and said output adapter to electrically connect said female D-miniature connectors to said male D-miniature connector.

8 Claims, 5 Drawing Sheets

DOUBLE-OUTPUT PORT CABLE ASSEMBLY FOR NOTEBOOK COMPUTERS

BACKGROUND OF THE INVENTION

The present invention relates to cable assemblies, and more particularly, the present invention relates to a cable assembly which has two output ports for connecting a pocket lan adapter and a printer connector to a notebook or lap top personal computer simultaneously.

A variety of portable personal computers are known and widely accepted for the advantage of high mobility. These personal computers can not only be operated independently but also connected to other systems or peripheral equipment for network on-line operation. However, in order to minimize space occupation, note book and lap top types of personal computers are simply equipped with a single output interface (one D-sub-miniature connector). When a notebook or lap top personal computer is to be connected to other systems forming into a computer network for on-line operation, a pocket lan adapter shall be required and connected to the output interface thereof (see FIG. 5). Under this condition, a printer can be connected to the notebook or lap top personal computer for printing data only when the network on-line operation has been stopped and the pocket lan adapter has been disconnected.

SUMMARY OF THE INVENTION

The present invention has been accomplished to eliminate the aforesaid problem. It is therefore an object of the present invention to provide a cable assembly which permits a notebook or lap top personal computer to be simultaneously connected to a computer network system and a printer to do network on-line operation or printing job alternatively. According to the preferred embodiment of the present invention, a cable assembly is comprised of an output adapter, which is comprised of a connector assembly having a male D-miniature connector, an output adapter having two female D-miniature connectors, and a coaxial cable connected between said connector assembly and said output adapter to electrically connect said female D-miniature connectors to said male D-miniature connector. By connecting the male D-miniature connector to the output port of a notebook personal computer with the two female D-miniature connectors respectively connected to a printer connector and a pocket lan adapter, the notebook personal computer can be simultaneously connected to a printer and a computer network system.

DETAILED DESCRIPTION OF THE PREFERRED EMBODIMENTS

Figure 1:
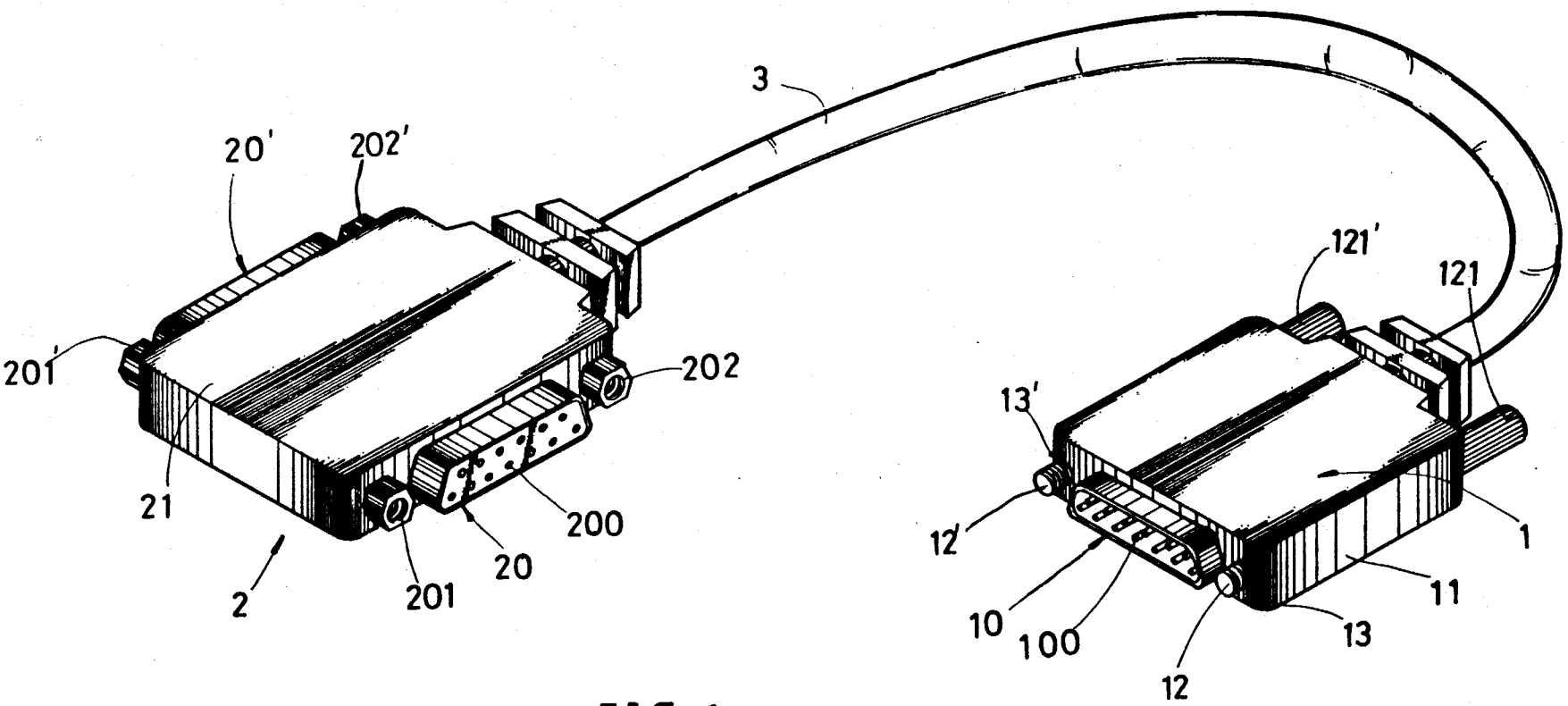
FIG. 1 is an elevational view of the preferred embodiment of the cable assembly of the present invention.

Referring to FIG. 1, a cable assembly comprises a connector assembly 1, an output adapter 2, and a coaxial cable 3 connected therebetween. The connector assembly 1 comprises a male D-miniature connector 10 covered with a shell 11. The male D-miniature connector 10 has contacts 100 for connecting to the output interface of a notebook personal computer 4 (see FIG. 3). The insulative shell 11 of the connector assembly 1 has two through holes 13,13' at two opposite sides by the male D-miniature connector 10, two screw bolts 12,12' respectively threaded into the through holes 13,13'. The screw bolts 12,12' have each one end connected with a knob 121 or 121' and an opposite end extended out of the insulative shell 11. By rotating the knobs 121,121', the screw bolts 12,12' are screwed inwards or outwards, and therefore the connector assembly 1 is fastened to or unfastened from the output interface of a notebook personal computer. The output adapter 2 comprises two female D-miniature connectors 20,20' covered with an insulative shell 21. The female D-miniature connectors 20,20' have female contacts 200 extended out of the insulative shell 21 at two opposite sides. The insulative shell 21 of the output adapter 2 comprises two opposite pairs of locknuts 201,202;201'202' for connecting a printer connector 5 and a pocket lan adapter 6 to the female contacts 200 of the female D-miniature connectors 20,20' respectively (see FIG. 3). The coaxial cable 3 is connected between the connector assembly 1 and the output adapter 2 for signal transmission.

Figure 2:
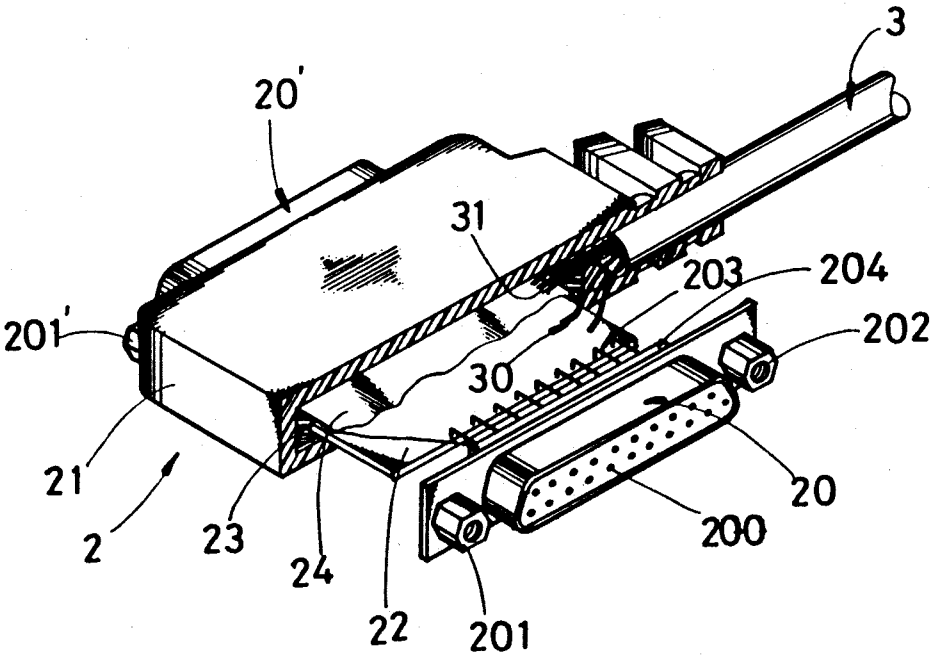
FIG. 2 is a partly sectional view of the output adapter showing the connection of the coaxial cable to the printed circuit board therein.

Referring to FIG. 2 and seeing FIG. 1 again, the insulative shells 11,21 are molded on the male D-miniature connector 10 or the female D-miniature connectors 20,20' through the process of injection molding. Before the process of injection molding, the terminals 203 of the female D-miniature connectors 20,20' as well as the central conductors 30 of the coaxial cable 3 are respectively welded to a printed circuit board 22, and then covered with a layer of insulator 23 by means of the process of injection molding, and a layer of aluminum foil 24. The aluminum foil 24 is partly connected to the metal shell 204 of the female D-miniature connectors 20,20'. The braided outside conductor 31 of the coaxial cable 3 is then welded to the aluminum foil 24 forming into an earth circuit. At the final, the insulative shell 21 is molded on the female D-miniature connectors 20,20' and the coaxial cable 3 through the process of injection molding. Similar process is performed in producing the connector assembly 1.

Figure 4:
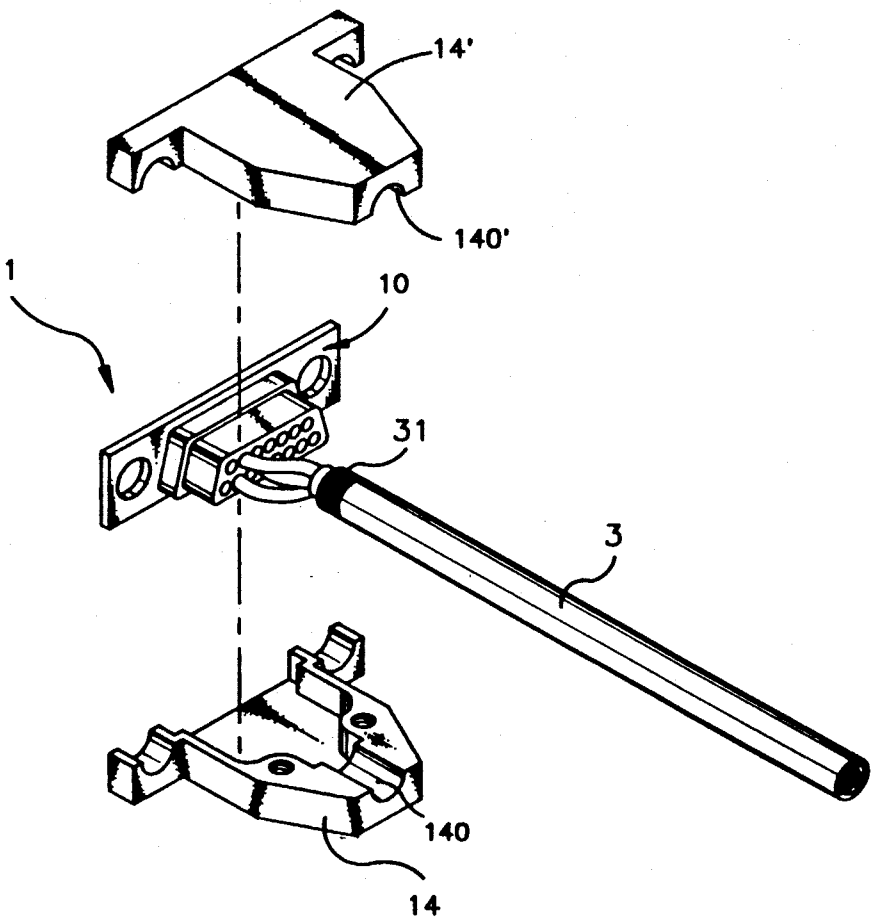
FIG. 4 illustrates an alternate form of the connector assembly which uses a metal outer shell instead of an insulative outer shell.
Figure 5:
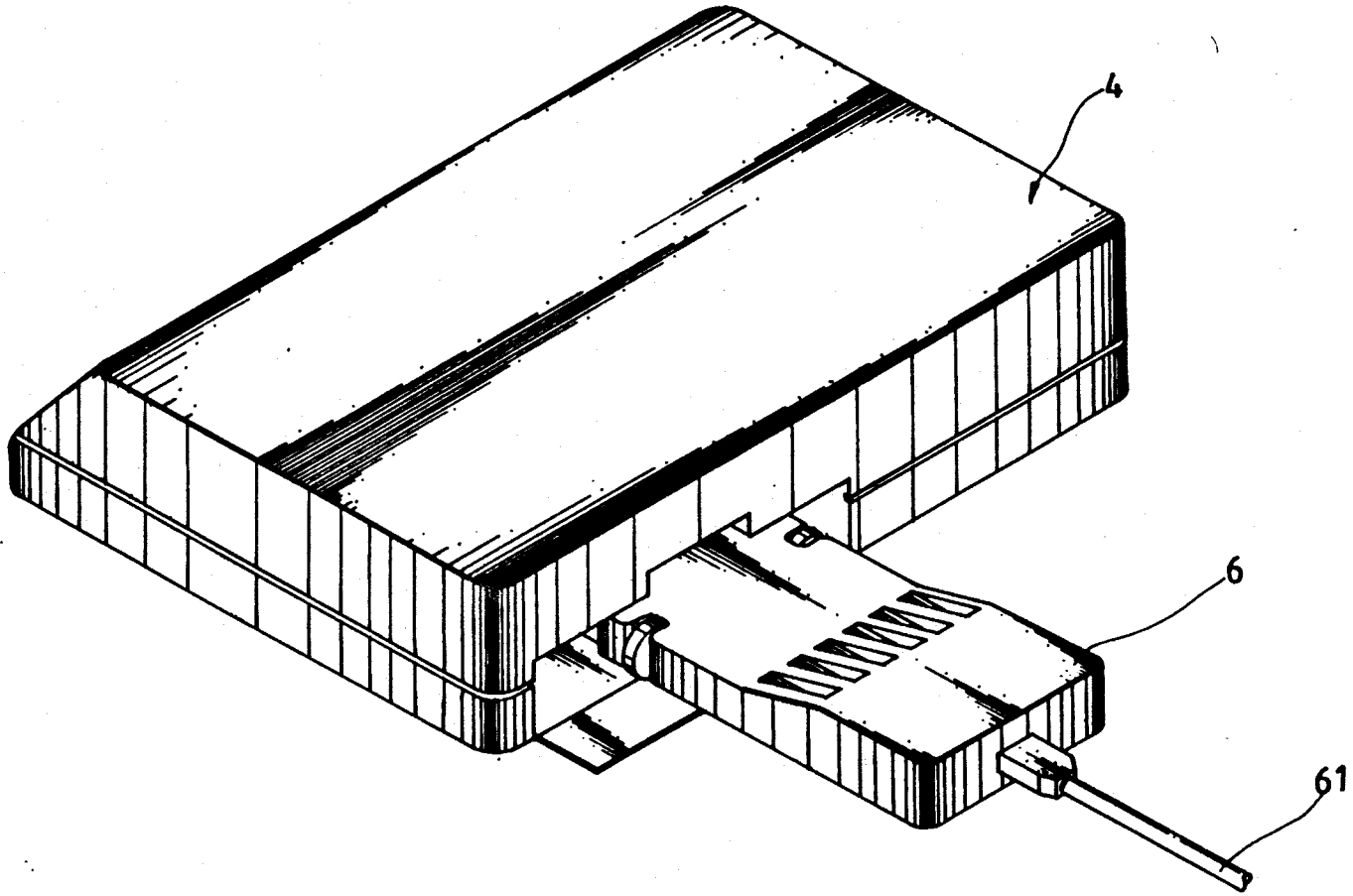
FIG. 5 PRIOR ART
FIG. 5 is an elevational view of a notebook personal computer which can not be connected to a printer when connected to a network computer system by a pocket lan adapter.

Referring to FIG. 4, therein illustrated is an alternate form of the connector assembly 1. In this alternate form, the connector assembly 1 is comprised of a male D-miniature connector 10 covered with two symmetrical metal shells 14,14'. The metal shells 14,14' have cable holders 140140', in which the braided outside conductor 31 of the coaxial cable 3 is held, forming into an earth circuit.

Figure 3:
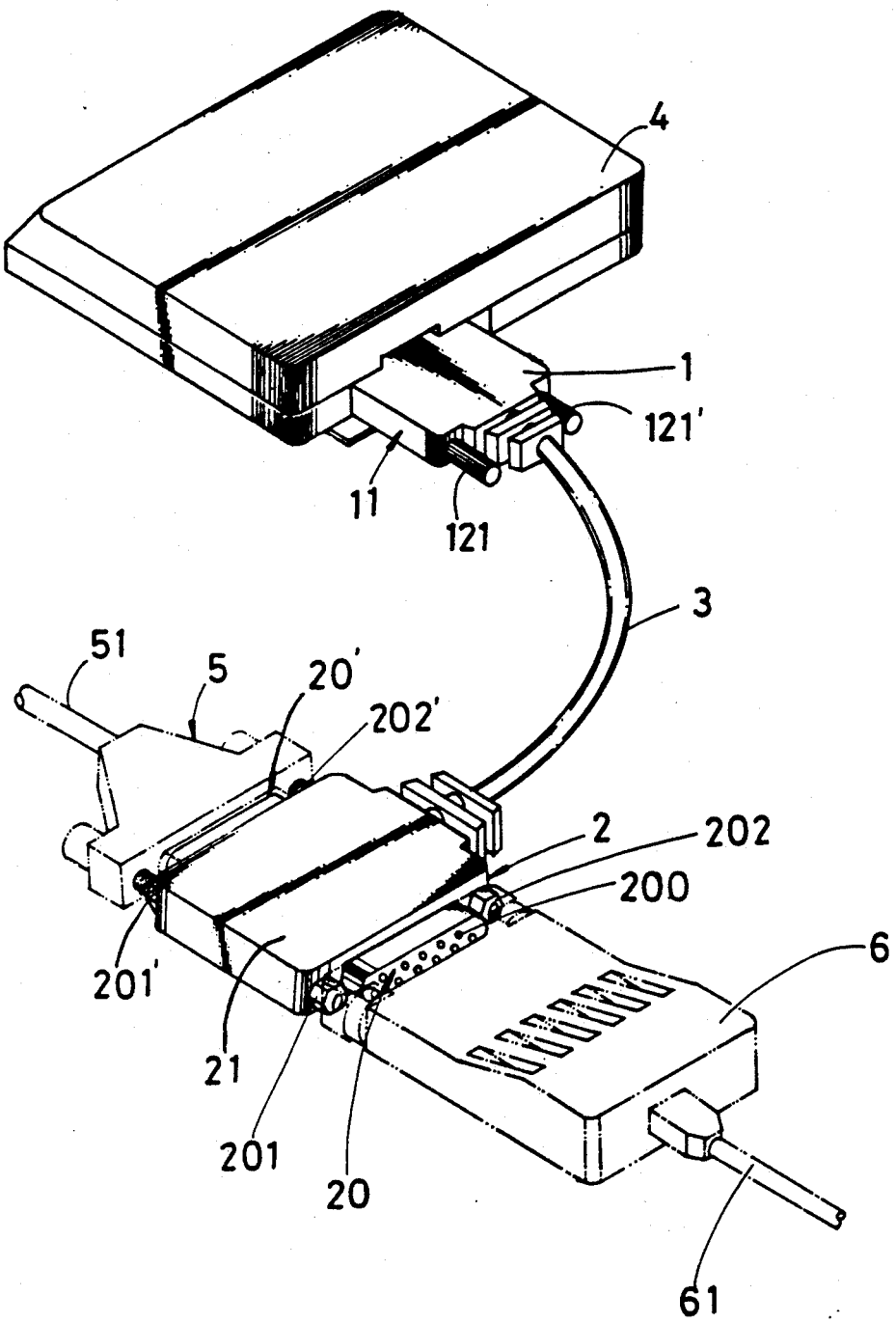
FIG. 3 illustrates the use of the present invention in connecting a notebook computer to a printer and a computer network system.

Referring to FIG. 3, when in use, the male D-miniature connector 10 of the connector assembly 1 can be connected to the output port of a notebook personal computer 4 with the two female D-miniature connectors 20,20 of the output adapter 2 respectively connected to a printer connector 5, which is connected to a printer (not shown) by a cable 51, and a pocket lan adapter 6, which is connected to a computer network system (not shown) by a cable 61. Therefore, the notebook personal computer 4 is simultaneously connected to a printer and a computer network system for computer network on-line operation or printing alternatively.

I claim:

1. A cable assembly comprising:

a connector assembly, said connector assembly comprising a male D-miniature connector;

an output adapter, said output adapter comprising two female D-miniature connectors; and a coaxial cable connected between said connector assembly and said output adapter to electrically connect said female D-miniature connectors to said male D-miniature connector.

2. The cable assembly according to claim 1, wherein said connector assembly and said output adapter have each an outer shell made through the process of injection molding.

3. The cable assembly according to claim 2, wherein said outer shell is consisted of two symmetrical metal shells.

4. The cable assembly according to claim 1, wherein said output adapter comprising a printed circuit board, through which the terminals of said female D-miniature connectors are electrically connected to said coaxial cable.

5. The cable assembly according to claim 4, wherein said printed circuit board and the terminals of said female D-miniature connectors are covered with a layer of insulator formed through the process of injection molding.

6. The cable assembly according to claim 5, wherein said layer of insulator is covered with a layer of aluminum foil.

7. The cable assembly according to claim 6, wherein said aluminum foil is connected to the metal shell of said female D-miniature connectors and the braided outside conductor of said coaxial cable.

8. The cable assembly according to claim 7, wherein said aluminum foil and said female D-miniature connectors are covered with an insulative outer shell formed through the process of injection molding.

* * * * *